US007210895B2

(12) United States Patent
Kotani et al.

(10) Patent No.: US 7,210,895 B2
(45) Date of Patent: May 1, 2007

(54) TURBO COMPRESSOR AND METHOD OF OPERATING THE TURBO COMPRESSOR

(75) Inventors: Koji Kotani, Tokyo (JP); Kazuo Takeda, Tokyo (JP); Haruo Miura, Tokyo (JP)

(73) Assignee: Hitachi Industries Co., Ltd., Tokyo (JP)

( * ) Notice: Subject to any disclaimer, the term of this patent is extended or adjusted under 35 U.S.C. 154(b) by 72 days.

(21) Appl. No.: 10/524,290

(22) PCT Filed: Aug. 12, 2002

(86) PCT No.: PCT/JP02/08217

§ 371 (c)(1),
(2), (4) Date: Feb. 11, 2005

(87) PCT Pub. No.: WO2004/016951

PCT Pub. Date: Feb. 26, 2004

(65) Prior Publication Data

US 2005/0265819 A1 Dec. 1, 2005

(51) Int. Cl.
*F04D 27/02* (2006.01)

(52) U.S. Cl. ..... 415/1; 415/17; 415/26; 415/27; 415/48; 415/49; 415/50

(58) Field of Classification Search ..... 415/1, 415/17, 26, 27, 28, 29, 48, 49, 50
See application file for complete search history.

(56) References Cited

U.S. PATENT DOCUMENTS

| | | | | |
|---|---|---|---|---|
| 6,551,068 | B2 * | 4/2003 | Blotenberg | 415/1 |
| 6,793,456 | B2 * | 9/2004 | Kotani et al. | 415/1 |

FOREIGN PATENT DOCUMENTS

| | | | |
|---|---|---|---|
| JP | 47-34897 | | 10/1972 |
| JP | 56-121898 | | 9/1981 |
| JP | 59-160098 | | 9/1984 |
| JP | 62-96798 | | 5/1987 |
| JP | 1-200095 | | 8/1989 |
| JP | 0435294 | A2 | 7/1991 |
| JP | 4-136498 | A | 5/1992 |
| JP | 7-88829 | B2 | 9/1995 |
| JP | 9-195982 | | 7/1997 |
| JP | 10-89287 | | 4/1998 |
| JP | 2001-90555 | | 4/2001 |

OTHER PUBLICATIONS

Korean Office Action including English translation (Seven (7) Pages) dated Feb. 27, 2006.

* cited by examiner

*Primary Examiner*—Christopher Verdier
(74) *Attorney, Agent, or Firm*—Crowell & Moring LLP

(57) ABSTRACT

A turbo-compressor being driven by an electric motor has an inlet guide vane and a blow-off valve. The surge limit line of the compressor is amended depending upon seasonal changes of temperature and pressure of a working gas to be sucked into the compressor. Upon the basis of the surge limit line amended, the minimum opening of the inlet guide vale is altered, thereby reducing the driving power or force of the compressor.

10 Claims, 5 Drawing Sheets

TURBO COMPRESSOR AND METHOD OF OPERATING THE TURBO COMPRESSOR

TECHNICAL FIELD

The present invention relates to a turbo-compressor and an operating method thereof, and in particular, to a turbo-compressor and an operating method for preventing the compressor from surging, thereby improving the operation of the turbo-compressor.

BACKGROUND ARTS

With a conventional turbo-compressor used, for example, in a chemical plant, in many cases, a discharge pressure is set to be almost constant. In such a turbo-compressor, however, the discharge pressure changes if temperature and/or pressure of a suction gas is changed, even when the rotational speed is constant. As a result it may be impossible to reach a predetermined discharge pressure. Then, as is described in Japanese Patent Laying-Open No. Sho 56-121898 (1981), for example, detection is made of the intake temperature and pressure of a working gas, as early as possible, so as to change the rotational speed of a driving machine in response to the intake temperature and pressure detected, thereby controlling the turbo-compressor so that the discharge pressure thereof arrives at the predetermined pressure.

Another example of a conventional turbo-compressor is described in Japanese Patent Laying-Open No. Hei 1-200095 (1989), for example. Within the multi-staged centrifugal compressor described in that publication, the minimum rotation speed of the driving machine is changed or altered in response to changes of temperature of the suction gas, so as to prevent it from an unstable phenomenon, i.e., so-called surging, so that the compressor is operated over a wide range with stability. As is also described, for example, in Japanese Patent Laying-Open No. Hei 10-89287 (1998), the temperature of a working gas sucked into a turbo-compressor is detected so as to change the rotational speed of the compressor in relation to about ⅓ power of a ratio between the detected temperature of the suction gas and a reference temperature thereof, thereby lowering the power of a shaft under a constant gas pressure and keeping the discharge pressure from the turbo-compressor constant.

In contrast to those conventional turbo-compressors, in each of which the constant gas pressure control is obtained by changing the rotational speed of the compressor, in Japanese Patent Laying-Open No. Sho 62-96798 (1987), for example, a change is described as made upon an angle of a vane of an inlet guide vane, which is provided at a suction side of the compressor, corresponding to the temperature of the gas sucked into the turbo-compressor so as to adjust a flow rate with high accuracy.

However, within turbo-compressors such as those which are described in Japanese Patent Laying-Open No. Sho 56-121898 (1981), Japanese Patent Laying-Open No. Hei 1-200095 (1989) and Japanese Patent Laying-Open No. Hei 10-89287 (1998) mentioned above, although the rotational speed of the compressor is controlled depending upon the temperature of the suction gas, in order to change the rotational speed within the turbo-compressor, which is driven by an electric motor, there is a need to provide an electric motor with an inverter drive, resulting in a high price. Also, with a compressor such as that described in Japanese Patent Laying-Open No. Sho 62-96798 (1987), no consideration is paid to the idea of expanding or widening the stable operation region of the compressor when conducting a capacity control thereupon but escaping from surging.

An object of the present invention, accomplished by taking the drawbacks of the conventional technologies mentioned above into consideration, is to provide a turbo-compressor driven by an electric motor, thereby enabling maintenance of a wide operation range or region without generating the surging and while keeping the discharge pressure thereof about constant. Another object, according to the present invention, is to provide a turbo-compressor having a simple structure which is able to maintain a wide operation range or region. According to the present invention, it is also another object to accomplish any one of those objects mentioned above.

DISCLOSURE OF THE INVENTION

According to the present invention, first, there is provided a turbo-compressor, comprising: an inlet guide vane enabling to change a vane angle thereof; a blow-off valve; a suction condition detecting means for detecting at least one of temperature and suction pressure of a working gas sucked into said turbo-compressor; and a controlling means having a database relating to a minimum angle of said inlet guide vane with respect to the suction condition.

According to the present invention, there is further provided a turbo-compressor, comprising: an inlet guide vane enabling a change in a vane angle thereof; a main body of a turbo-compressor; a discharge pressure detecting means for detecting discharge pressure of said turbo-compressor; a check valve positioned at the same side of said turbo-compressor main body as said discharge pressure detecting means; a blow-off valve for blowing off a gas compressed within said turbo-compressor; a suction condition detecting means positioned at an upstream side of said inlet guide vane for detecting at least one of temperature and suction pressure of a working gas sucked into said turbo-compressor; and a regulator for controlling an angle of said inlet guide vane and opening/closing of said blow-off valve. The turbo-compressor further comprises a surging detecting means provided between said check valve and said turbo-compressor main body, and a database provided within said regulator for describing therein a relationship between a suction condition and a minimum inlet guide vane angle with respect to a target pressure, respectively.

According to the present invention, in a turbo-compressor as described above, it is preferable that said regulating means renews data of the minimum inlet guide vane angle within said database when said surging detecting means detects surging, and it is also possible for the compressor to further comprise a higher controller for controlling said regulating means.

Further, according to the present invention, there is also provided an operation method for controlling discharge pressure of said turbo-compressor using an inlet guide vane and a blow-off valve, comprising the steps of: detecting a value through a temperature detecting means or a pressure detecting means; obtaining a minimum inlet guide vane angle at that detection value by referring to data of the minimum inlet guide vane angle, which are memorized in a regulator equipped with said compressor, based upon said detection value; and driving said inlet guide vane at that minimum angle or greater than that minimum angle through a vane driver.

Also, according to the present invention, it is preferable to renew said data of the inlet guide vane angle while opening the inlet guide vane by a predetermined amount when a surging is generated within said turbo-compressor; to memorize a characteristic of the discharge pressure of the compressor to the suction flow rate into the regulator; and, when the inlet guide vane angle which is obtained from said characteristic upon changing of said suction flow amount becomes smaller than the minimum inlet guide vane angle, to set the inlet guide vane at the minimum inlet guide vane angle while opening the blow-off valve. A deviation of a vane angle is obtained when the discharge pressure is higher than a target discharge pressure, and, when the vane angle added with the deviation becomes equal to or less than the minimum inlet guide vane angle, the inlet guide vane is set at the minimum inlet guide vane angle while opening the blow-off valve. The compressor is shifted into a non-load operation condition by fully opening the below-off valve and the inlet guide vane when the discharge pressure is higher than a target discharge pressure, and when this condition continues for a predetermined time period, the compressor operation is stopped.

BRIEF DESCRIPTION OF DRAWINGS

FIGS. 1 through 3 are views for explaining about the characteristics of the turbo-compressor, wherein:

FIG. 1 is a view for explaining a relationship between suction flow rate and discharge pressure;

FIG. 2 is a view for explaining changes on the characteristic curve due to the difference in temperature of a suction gas; and FIG. 3 is a view for explaining changes on the characteristic curves due to the difference in the suction pressure.

BEST MODE FOR CARRYING OUT THE INVENTION

Figure 1:
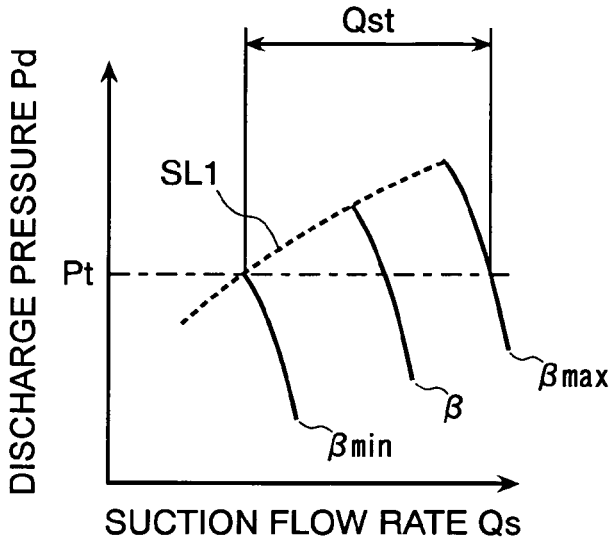
Figure 2:
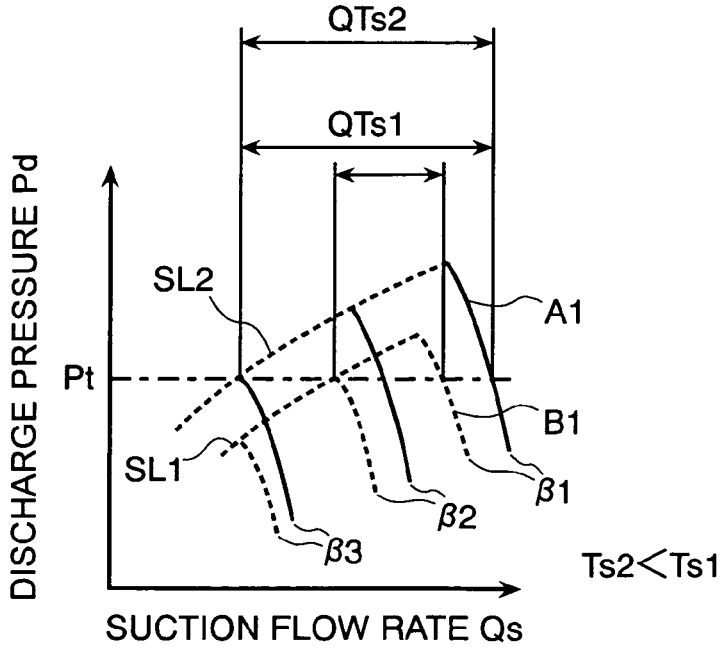
Figure 3:
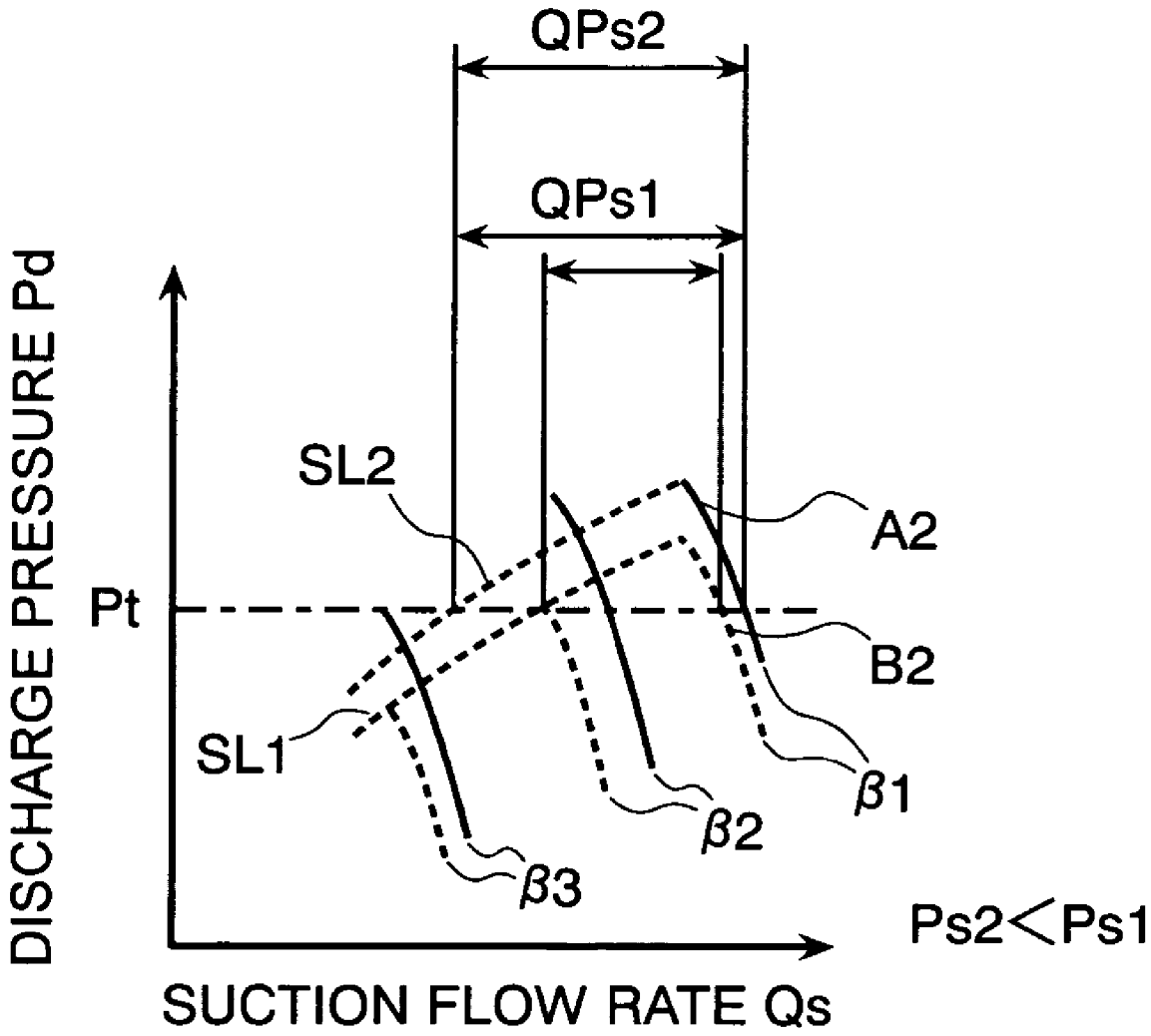

Hereinafter, explanation will be made about a turbo-compressor, according to an embodiment of the present invention, by referring to the drawings attached herewith. FIGS. 1 to 3 are views for showing the characteristics of the compressor, in particular, in a case where a constant gas pressure control is applied for controlling the rotational speed of the turbo-compressor so that it stays constant, while providing an inlet guide vane at the suction side of that turbo-compressor. Within such a kind of the conventional turbo-compressor, however, the minimum opening "$\beta_{min}$" of the inlet guide vane is set at a constant, so as to avoid surging therefrom.

FIG. 1 shows a "Qs–Pd" characteristic curve, which shows a relationship between the flow rate and the discharge pressure within the turbo-compressor, in particular, when the constant gas pressure control is applied so that the discharge pressure "Pd" comes to be a target pressure "Pt". A dotted line "SL" shows a surging line. When changing an inlet guide vane opening "β" so as to change the suction flow rate "Qs", the suction flow rate changes along with a one-chain dotted line shown within the figure, so that the discharge pressure "Pd" comes to be equal to the target pressure "Pt". Then, when the inlet guide vane opening "β" comes to be equal or less than the minimum opening "$\beta_{min}$" thereof, the surging is generated within the constant gas pressure control. On the contrary to this, when operating the compressor while keeping the inlet guide vane opening "β" constant, the discharge pressure "Pd" changes, as is shown by a solid line in the figure, depending upon changes of the suction flow rate "Qs". A range or region of a flow rate when the control is made so as to obtain the target discharge pressure "Pd" while changing the inlet guide vane opening from the maximum, i.e., "$\beta_{max}$" up to the minimum, i.e., "$\beta_{min}$", is a stable operation range or region "Qst".

Within the turbo-compressor, when the temperature of the working gas sucked into the compressor is changed, the characteristics thereof are also changed. For example, if the temperature "Ts" of the sucked-in working gas is the temperature "Ts1" of a summer season, i.e., Ts=Ts1, then the discharge pressure "Pd" shows such a characteristic to the suction flow rate "Qs", as is shown by a broken line "B1" in the figure. If the temperature "Ts" of the suction gas falls down to that of winter time, i.e., Ts=Ts2, then the discharge pressure "Pd" has a characteristic as shown by a solid line "A1" in the figure.

In FIG. 2, a stable operation region "QTs2" of the compressor is wide when the temperature "Ts" of the sucked working gas is low (such as, Ts=Ts2), as compared to the stable operation region "QTs1" when the suction gas temperature "Ts" is high (such as, Ts=Ts1). Thus, according to a conventional method for avoiding surging therefrom, the opening "β" of the variable inlet guide vane is kept at the maximum opening "$\beta_{max}$", even in the winter season where the temperature "Ts" of the suction gas is low. However, it is necessary to set up or determine the opening of the inlet guide vane, upon the basis of a surging critical flow rate of the summer season, larger than that of the winter season, since it is possible that such surging may occur. As a result thereof, even when no surging will occur at that guide vane operation because of the low temperature of the suction gas, it is compelled to conduct a wasteful operation by operating the compressor while blowing off the gas through the flow-off valve opened for avoiding surging.

However, the characteristics of the turbo-compressor also change depending upon the suction pressure of the working gas. FIG. 3 shows a change in the relationship between the suction flow rate "Qs" and the discharge pressure "Pd". Change of the discharge pressure is shown by a broken line "B2" when the suction flow rate is changed while keeping the angle of the inlet guide vane at a constant, in particular, if the suction pressure is low (Ps=Ps1), while change of the discharge pressure is shown by a solid line "A2" when change is made in a similar manner but if the suction pressure is high (Ps=Ps2). Also, surge lines are shown by broken lines "SL1" and "SL2", respectively, each of which defines a boundary of generating the surging under each condition thereof. As is shown in FIG. 3, the stable operation region "QPs1" under the suction pressure "Ps1" is narrower than the stable operation region "QPs2" under the suction pressure "Ps2". Namely, the higher the suction pressure "Ps", the wider the stable operation region. However, the stable operation region of the turbo-compressor also changes depending upon the temperature and the pressure of the suction gas and also due to dirt inside and/or a secular degradation thereof, etc.

Figure 4:
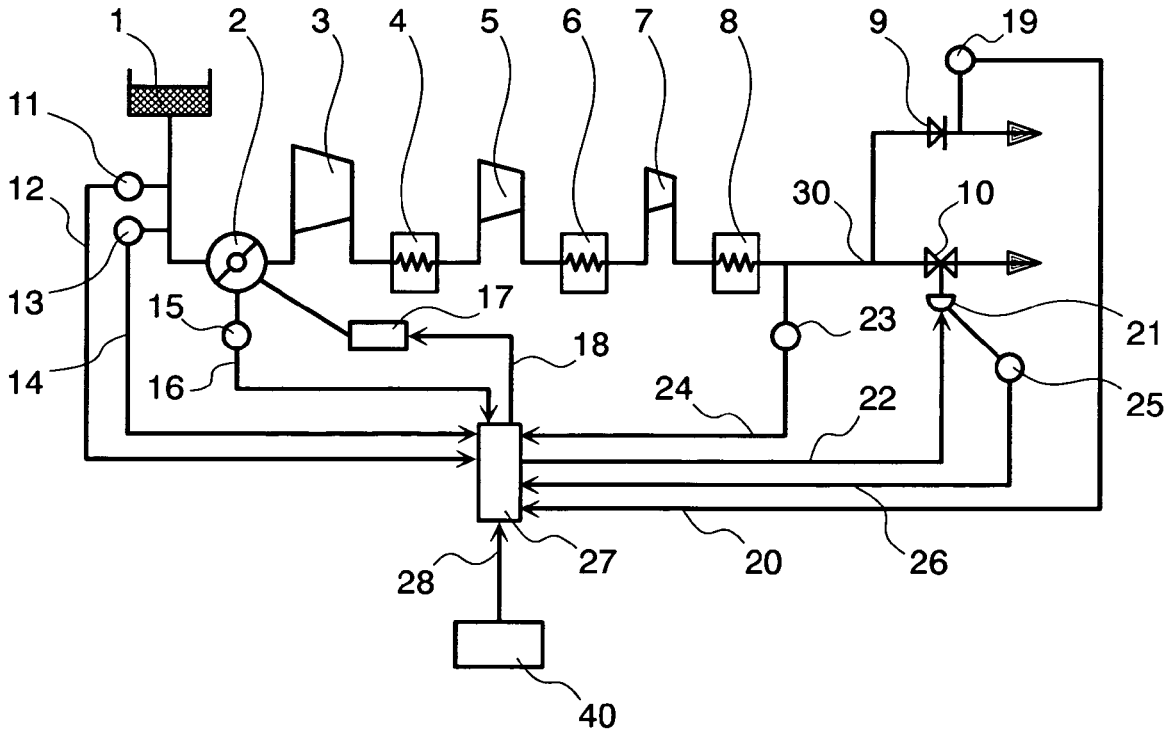
FIG. 4 is a system view of the turbo-compressor according to one embodiment of the present invention.

Within the turbo-compressor, in which the characteristics change depending upon the suction condition and so on, in this manner, movements for achieving an effective flow rate control up to the surge limit will be explained by referring to FIG. 4. FIG. 4 is a view showing an embodiment of the turbo-compressor, driven by an electric motor, according to one embodiment of the present invention. Solid lines depict the actual flow conditions of the working gas, while broken lines depict electric flows of various signals. The turbo-compressor according to the present embodiment has three (3) stages of compressor chambers 3, 5 and 7. Between each pair of the compressor chambers are provided inter coolers 4 and 6, respectively, and downstream of the last stage compressor 7 is provided an after cooler 8. At an inlet side of the first stage compressor 5 is provided a variable inlet guide vane 2, and upstream of that variable inlet guide vane 2 is provided a suction filter 1, respectively.

Within a turbo-compressor constructed in such a manner, after passing through the suction filter 1, the working gas flows into the variable inlet guide vane 2. The temperature "Ts" and the pressure "Ps" of suction gas are always changing depending upon the changes of temperature and pressure in the periphery of the turbo-compressor, and pressure loss of the filter and so on, as well. Then, a temperature sensor 11 is attached or provided, within a flow pass between the suction filter 1 and the inlet guide vane 2, for detecting the suction gas temperature "Ts". In a similar manner, a pressure sensor 13 is also attached or provided within a flow pass for detecting the suction pressure "Ps". A signal of the suction gas temperature, which is detected by the temperature sensor 11, is transmitted to a regulator 27 through a signal line 12. A signal of the suction pressure, which is detected by the pressure sensor 13, is also transmitted to the regulator 27, but through a signal line 13.

For detecting a vane opening "β" of the inlet guide vane 2, a vane opening angle detector 15 is provided in the vicinity of the inlet guide vane 2. A signal of the vane opening, which is detected by the vane opening angle detector 15, is transmitted to the regulator 27 through a signal line 16.

The working gas, which is adjusted in flow rate through the inlet guide vane 2, is compressed in each of the compressor chambers 4, 6 and 8, to be high in temperature thereof. That working gas of high temperature achieves the thermal exchange between a cooling water or a cooling air, within the inter coolers 4 and 6 and the after cooler, which are disposed downstream of the compressor chambers 4, 6 and 8, to be cooled down to about 40° C. Downstream of the after cooler 8 is disposed a check valve 9, and a pressurized gas passing through that check valve 9 is sent to a customer or a consumer. Downstream of the check valve 9 is attached a pressure sensor 19 for detecting the discharge pressure "Pd". A signal of the discharged pressure, which is detected through that pressure sensor, is transmitted to the regulator 27 through a signal line 20.

Between the after cooler 8 and the check valve 19 is formed a branch pipe portion 30, within which a blow-off valve 10 is attached. This blow-off valve 10 is provided for preventing the discharge pressure "Pd" from becoming or increasing too much. An instruction signal from the regulator 27 is inputted into a blow-off valve driver 21 through a signal line 22, and the blow-off valve 10 is opened, thereby preventing the discharge pressure from increasing therein. The blow-off valve 10 is adjustable in the opening angle thereof. Then, a blow-off valve opening angle detector 25 is attached on the blow-off valve 10, or on the blow-off valve driver 21, for detecting the opening of the blow-off valve 10. The opening angle of the blow-off valve 10, which is detected through the blow-off valve opening angle detector 25, is transmitted to the regulator 27 through a signal line 26. Between the branch pipe portion 30 and the after cooler 8 is attached a surging detector 23, and a signal detected by that surging detector 23 is transmitted to the controller 27 through a signal line 24. Further to the regulator 27 is transmitted a target pressure through a signal line 28 from a higher controller means 40.

Figure 5:
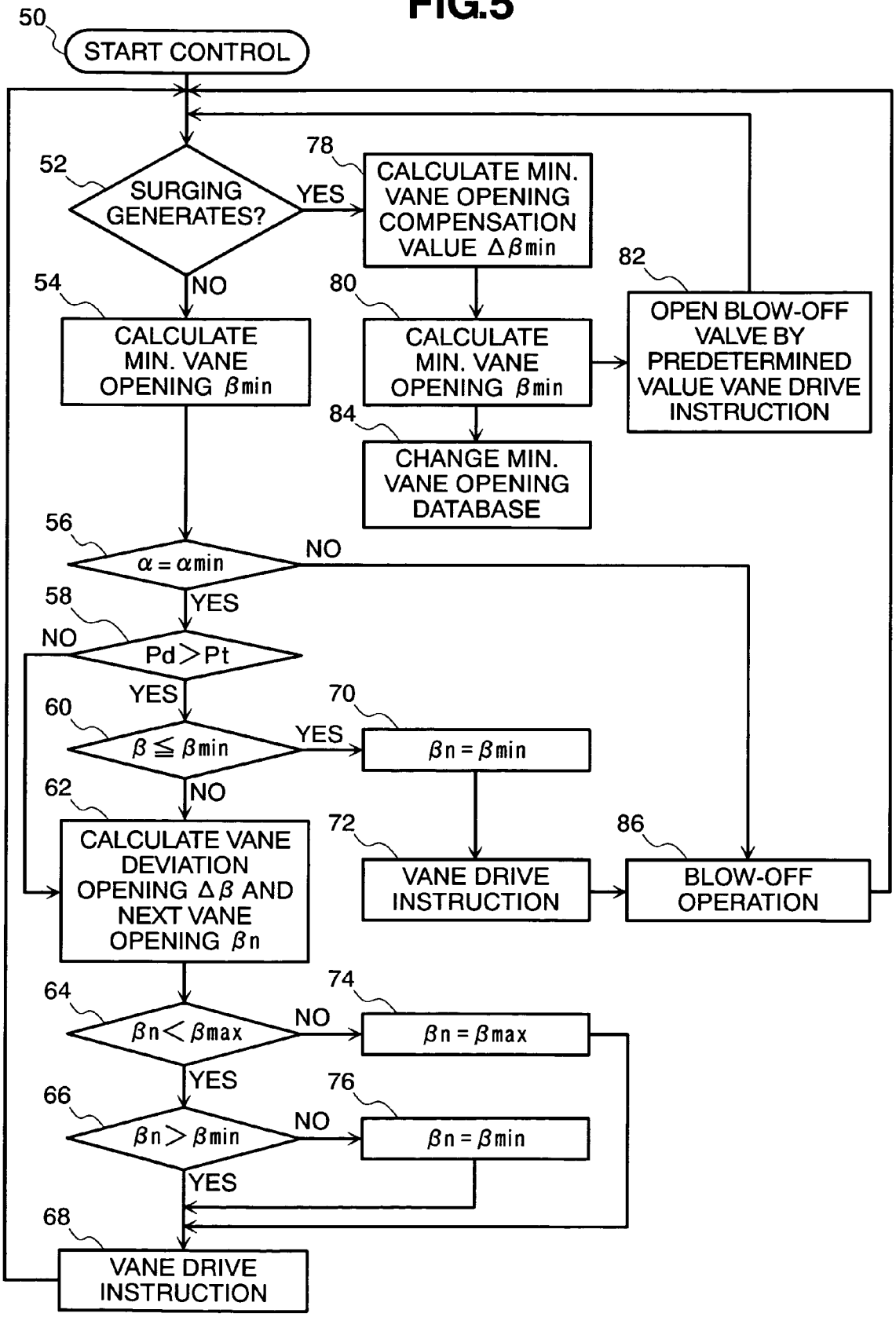
FIGS. 5 and 6 are flowcharts showing an operation control of the turbo-compressor shown in FIG. 4.
Figure 6:
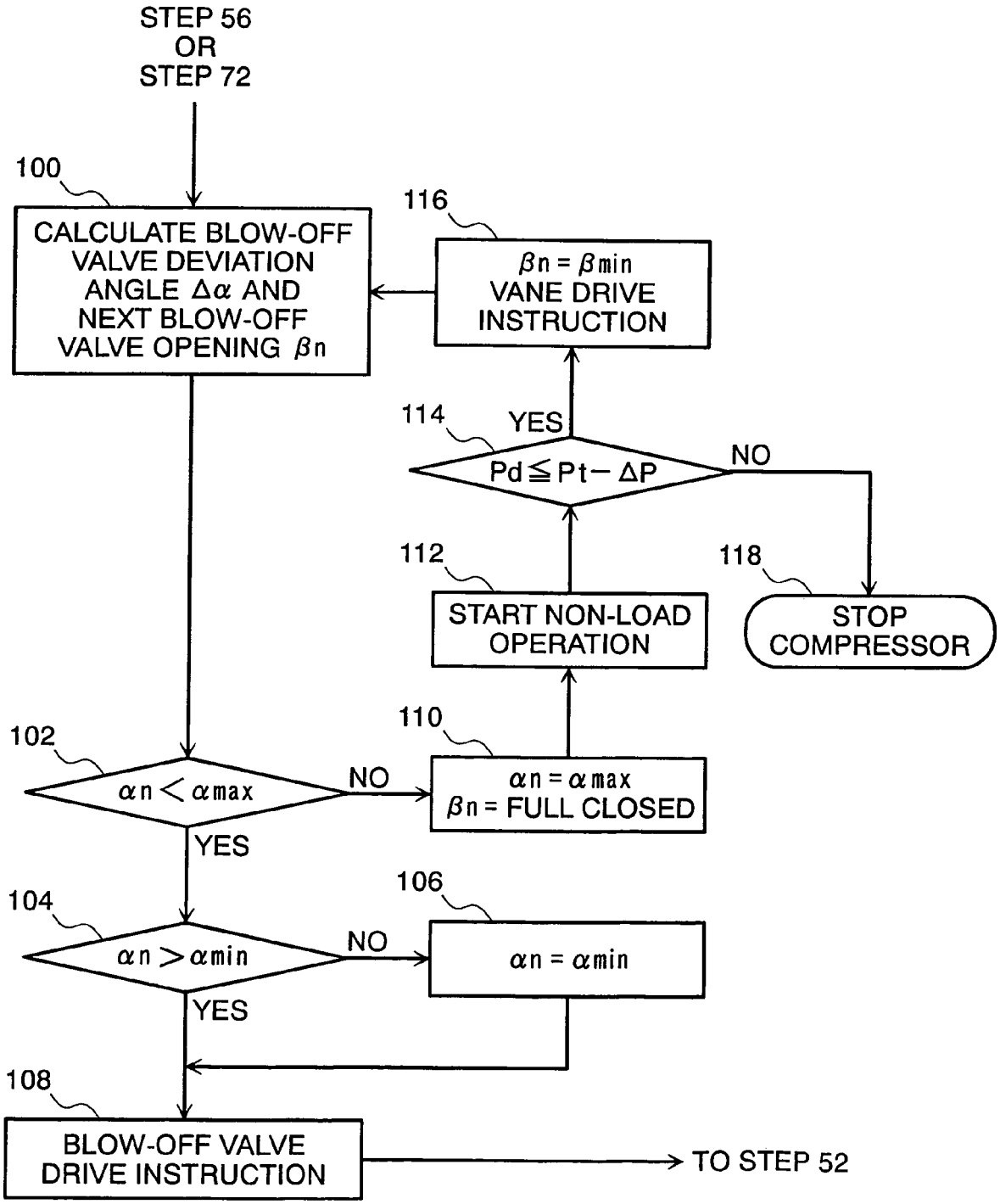

Detailed explanation will be given about the operation of the regulator 27, into which the various signals are inputted, by referring to the flowchart shown in FIGS. 5 and 6. Into the regulator 27 is inputted the target pressure "Pt" from the higher controller means 40. When the regulator 27 starts the control thereof (step 50), it checks on whether the surging is generated or not within the turbo-compressor, using the surging detector 23 (step 52). The surging detector 23 is attached within the upstream side of the check valve 9, and it transmits the signal 24, i.e., the discharge "Pda" of the compressor, to the regulator 27. When the time change rate, APda/At of the "Pda", exceeds a predetermined value thereof, an abrupt pressure change is produced therein, and therefore, it is assumed that surging is generated.

When it is determined that no such surging is generated within the compressor in step 52, calculation is made upon the minimum vane opening "$\beta_{min}$" to be set to the inlet guide vane 2 using the temperature "Ts" and the pressure "Ps" of the suction gas which are detected through the temperature sensor 11 and the pressure sensor 13 (step 54), thereby making a renewal upon the setup of the minimum opening "$\beta_{min}$" of the inlet guide vane 2. Next, upon the basis of the signal, which is detected by the opening angle detector 25 for the blow-off valve 10, it is determined whether the blow-off valve opening angle "α" is in either a full-closed condition "$\alpha_{min}$" or an opened condition (step 56).

When the blow-off valve 10 is in the full-closed condition "$\alpha_{min}$", since the compressor is under the loading operation, the discharge pressure "Pd" is compared to the target pressure "Pt" (step 58). If the discharge pressure "Pd" is higher than the target pressure "Pt" (Pd>Pt), a consumption gas volume is smaller than that of a compressed gas, which is generated within the compressor; therefore, the flow rate is reduced. The vane opening "β" of the inlet guide vane 2, which is detected thought the vane opening angle detector when detecting the blow-off opening angle "α", is compared to the minimum guide vane opening "$\beta_{min}$", which is set up in advance (step 60). When the setup minimum opening "$\beta_{min}$" is equal or greater than the vane opening, which is detected by the vane opening angle detector 15, i.e., $\beta \leqq \beta_{min}$, the vane opening "β" is widened up to the minimum opening "$\beta_{min}$" (steps 70 and 72). Under such a condition, it is impossible to conduct the flow rate control using the inlet guide vane, and therefore, the operation is shifted into the so-called blow-off operation.

When it is determined that the vane opening "β" detected by the vane opening angle detector 15 is larger than the setup minimum vane opening "$\beta_{min}$" ($\beta > \beta_{min}$) in the determination of the inlet guide vane opening in the step 60, and also when the discharge pressure "Pd" is lower than the target pressure (Pd<Pt) in the determination of the discharge pressure in the step 58, the flow rate control is done so that an appropriate load operation can be obtained. Then, from the difference between the target pressure "Pt" and the discharge pressure "Pd", deviation of the flow rate is converted into a deviation value "Δβ" of the vane opening, so as to calculate out a vane opening "βn(=β+Δβ)" (step 62) to be set up the next time. The vane opening "βn" calculated is compared to the maximum vane opening "$\beta_{max}$" (step 64).

When the vane opening "βn" to be set up is smaller than that maximum vane opening "$\beta_{max}$", i.e., $\beta n < \beta_{max}$, the setup vane opening "βn" is compared to the minimum vane opening "$\beta_{min}$" (step 66). If the setup vane opening "βn" is larger than the minimum vane opening, an instruction is transmitted to the vane driver 17, moving the inlet guide vane only by the deviation opening Δβ, so that it comes up to be the setup vane opening "βn" (step 68).

When it is determined that the setup vane opening "βn" is equal or greater than the maximum vane opening "$\beta_{max}$" in the step 64 ($\beta n \geqq \beta_{max}$), because the vane cannot open wider than the maximum vane opening, the setup vane opening "βn" is set at the maximum vane opening "$\beta_{max}$" ($\beta n = \beta_{max}$), again (step 74). In similar manner, when it is determined that the setup vane opening "βn" is equal or smaller than the minimum vane opening "$\beta_{min}$" in the step 66, the setup vane opening "βn" is set at the minimum vane opening "$\beta_{min}$" ($\beta n = \beta_{min}$), again (step 76). In the manner as was mentioned above, the setup vane opening "βn" is determined, so as to drive the inlet guide vane 2 up to the setup vane opening "βn" using the vane driver 17 (step 68). Thereafter, the process turns back to the step 52, for preparation of the next measurement thereof.

When it is determined that the blow-off valve 10 is not in the full-closed condition in the step 56, since it already entered into a blow-off operation condition (step 86), the volume of blow-off is controlled or adjusted, thereby obtaining the flow-rate control or regulation. The controlling steps in that blow-off operation are shown in FIG. 6. From the discharge pressure "Pd" and the target pressure "Pt" are calculated out a deviation opening "Δα" of the blow-off valve and a next setup blow-off valve opening "αn" (step 100). The calculated setup blow-off valve opening "αn" is compared to the maximum blow-off valve opening "$\alpha_{max}$" (step 102). When the setup blow-off valve opening "αn" is smaller than the maximum blow-off valve opening "$\alpha_{max}$" ($\alpha n < \alpha_{max}$), then the setup blow-off valve opening "αn" is compared to the full-closed angle "$\alpha_{min}$", i.e., the minimum blow-off valve opening (step 104). If the setup blow-off valve opening "αn" is equal or smaller than the full-closed angle "$\alpha_{min}$" ($\alpha n \leqq \alpha_{min}$), since this means that the blow-off operation was already completed, the setup blow-off valve opening "αn" is set at the full-closed angle "$\alpha_{min}$", again (step 106).

Upon determining the setup blow-off valve opening "αn", the flow-off valve driving instruction signal 26 is transmitted to the blow-off valve driver 21, so that the blow-off valve 10 is driven up to the setup blow-off valve opening "αn" (step 108). The process turns back to the step 52 for preparation of the next measurement. Herein, if the setup blow-off valve opening "αn" comes up to be equal or greater than the maximum blow-off valve opening "$\alpha_{max}$" ($\alpha n \geqq \alpha_{max}$) in the step 102, for avoiding surging therefrom, the setup blow-off valve opening "αn" is set at the maximum blow-off valve opening "$\alpha_{max}$". At the same time, the inlet guide vane is turned into the full-closed condition (step 110), to be shifted into a non-load operation (step 112). During the non-load operation, the discharge pressure "Pd" is always measured (step 114). Upon making confirmation that the discharge pressure "Pd" comes to be smaller than the target pressure "Pt" by a predetermined value "ΔP", the inlet guide vane opening "β" is widened up to the minimum vane opening "$\beta_{min}$" (step 114). Thereafter, the process turns back to the step 100, to start the blow-off operation, again. If the discharge pressure "Pd" comes down to a value obtained from subtraction of the target pressure "Pt" by the predetermined value "ΔP" ($Pd \geqq Pt - \Delta P$), even when a predetermined time period elapses, then the compressor is stopped (step 118).

When the surging generation is detected in the step 52, then the inlet guide vane is opened for escaping from that surging. An amount of change upon opening of the inlet guide vane 2 at that time is calculated out in a step 78. In this step 78, a minimum compensation value "$\Delta\beta_{min}$" of the vane opening is calculated out from an equation or a table, which is preset corresponding to the temperature and the pressure of suction gas. Further, this amount of change may be set at a predetermined value (a constant value), such as, "1 degree", for example. Since the compensation value "$\Delta\beta_{min}$" of the vane opening is obtained, then the minimum vane opening "$\beta_{min} = (\beta + \Delta\beta_{min})$" is renewed in a step 80. For avoiding the surging, the inlet guide vane 2 is opened up to the renewed minimum vane opening "$\beta_{min}$", and also the compressor increases the suction flow rate for it; therefore, the blow-off operation is conducted for the flow rate increase (step 82). This rate can be achieved through widening the opening of the blow-off valve by the predetermined value. Because of urgency when the surging is detected, those steps 52, 78–82 must be executed, almost simultaneously. And, in parallel with the step 82, or after completion of the step 82, the renewal is conducted upon the database in relation to the minimum vane opening "$\beta_{min}$" (step 84).

When the blow-off valve opening "αn" is at the maximum blow-off valve opening "$\alpha_{max}$" in the step 86, since an amount of load is small, the condition is kept as it is for a predetermined time period, and during this time period the comparison between the discharge pressure "Pd" and the target pressure "Pt" (step 100) continues. When the discharge pressure "Pd" is equal or greater than the target pressure "Pt" even after elapsing of the predetermined time period, then the compressor is stopped (step 118). Also, when the discharge pressure "Pd" is smaller than the target pressure "Pt", the process moves to a step 116.

Next, explanation will be made about the setup of the minimum vane opening "$\beta_{min}$".

Selection is made upon a value having a possibility of being setup as the target pressure "Pt". If such values are in plural pieces, such as, "k" pieces, for example, then they are determined to be Pt(1) to Pt(k), sequentially, from the lowest one. The minimum value "Ts(min)" and the maximum value "Ts(max)" are determined within a range where they can be expected to have under the circumstances of using the compressor therein. The range of temperature of suction gas between the minimum value "Ts(min)" and the maximum value "Ts(max)" is divided into "m" pieces of discrete numbers "Ts(1)", "Ts(2)" . . . "Ts(m)". For each of the "k" pieces of the preset target pressures "Pt(i)(i=1, 2 . . . k)", a relationship between the temperatures "Ts(j)(j=1, 2 . . . k)" of suction gas and the minimum vane opening "$\beta_{min}$(i,j)" is stored into the database, which is provided within the higher controller means 40 or the regulator 27. Further, as the data to be memorized into this database, a standard suction pressure "Ps0" is applied to be the suction pressure. Accordingly, the data to be memorized therein come into an array of data having "k×m" pieces of data thereof.

The minimum vane opening "$\beta_{min}$" can be calculated out, as below:

$$Pt1 = Pt\frac{(Pt + Pa)/(Ps0 + Pa)}{(Pt + Pa1)/(Ps + Pa1)}$$

When receiving the values of the temperature "Ts" and the pressure "Ps" of suction gas in the form of the signals thereof, compensation is made upon the target pressure "Pt" using the suction pressure "Ps", in accordance with the equation mentioned above. Thus, the target pressure "Pt" is compensated using a property, i.e., that the characteristic curves between the flow rate and the discharge pressure (i.e., the "Qs–Pd" characteristic) come to be similar to each other, if they are coincident.

Herein, "Pt1" is the target pressure after compensation, and it is used only for the purpose of calculating out the minimum vane opening "$\beta_{min}$" Also, "Pa" is the atmospheric pressure under a standard condition, while "Pa1" the atmospheric pressure when detection is made upon the suction condition. Since the target pressure "Pt1" after compensation can be obtained, the minimum vane opening "$\beta_{min}$" can be calculated out through the interpolation using the database mentioned above. However, if the target pressure "Pt1" after compensation comes outside of the region of the preset target pressure from Pt(1) to Pt(k), then the minimum vane opening "$\beta_{min}$" is calculated out through extrapolation, in the place thereof.

A method of changing the minimum vane opening at the time surging is generated will now be explained. A compensation value "Pt1" of the target pressure is obtained from the suction pressure "Ps" and the target pressure "Pt" when the surging generates. If the minimum vane opening is "$\beta_{min}$" at the time when the suction gas temperature is "Ts" and the compensation target pressure is "Pt1", then the database is changed, following to "$\beta_{min}1=\beta_{min}+\Delta\beta_{min}$". As was mentioned above, "$\Delta\beta_{min}$" can be obtained from the measured values, such as, those of the suction gas temperature "Ts" and the suction pressure "Ps", for example, by using an equation or a data table. Or, it may be given to be a predetermined value (for example, a constant value). Since "$\beta_{min}$" can be guided or obtained by using "$\beta_{min}(i,j)$" in a periphery thereof through the interpolation, and if the interpolation is linear, then it is possible to achieve a renewal of the minimum vane opening, by changing the minimum vane opening "$\beta_{min}(i,j)$" to "$\beta_{min}(i,j)+\Delta\beta_{min}$". After completion of that compensation, it can be assured that the minimum vane opening "$\beta_{min}$" will never come down to be equal or lower than the vane opening determined by the surging line, even if the suction gas temperature "Ts" and the compensation target pressure "Pt1" come back to the same values at the time when the surging is generated before.

As mentioned above, according to the present invention, it is possible to protect the compressor from the surging within a wide range, by only detecting the temperature and the suction pressure of the working gas sucked into the turbo-compressor. And, it is also possible to operate the turbo-compressor with stability thereof. Further, although the setup of the minimum vane opening is conducted based upon the change of the suction gas temperature, according to the present embodiment, it may be also conducted in the same manner, but upon the basis of change of the suction pressure, as was mentioned above.

What is claimed is:

1. A turbo-compressor, comprising:

an inlet guide vane enabling a change in a vane angle thereof;

a blow-off valve;

a suction condition detecting means for detecting at least one of temperature and suction pressure of a working gas sucked into said turbo-compressor; and a controller means having a database relating to a minimum angle of said inlet guide vane with respect to the suction condition, wherein said controller means determines the minimum angle by referring to said database and renews the database depending upon detection of surging of said turbo-compressor.

2. A turbo-compressor, comprising:

an inlet guide vane enabling a change in a vane angle thereof;

a main body of the turbo-compressor;

a discharge pressure detecting means for detecting discharge pressure of said turbo-compressor;

a check valve being positioned at the same side of said turbo-compressor main body as said discharge pressure detecting means;

a blow-off valve for blowing off a gas compressed within said turbo-compressor;

a suction condition detecting means positioned at an upstream side of said inlet guide vane for detecting at least one of temperature and suction pressure of a working gas sucked into said turbo-compressor;

a regulator for controlling an angle of said inlet guide vane and opening/closing of said blow-off valve; and a surging detecting means provided between said check valve and said turbo-compressor main body;

wherein a database is provided within said regulator for describing therein a relationship between the suction condition and a minimum inlet guide vane angle with respect to a target pressure, respectively;

wherein said regulator determines the minimum inlet guide vane angle by referring to said database; and wherein the database is renewed when said surging detection means detects surging.

3. The turbo-compressor as defined by claim 2, wherein said regulator renews data of the minimum inlet guide vane angle within said database when said surging detecting means detects the surging.

4. The turbo-compressor as defined by claim 2, further comprising a higher controller for controlling said regulator.

5. The turbo-compressor as defined by claim 3, further comprising a higher controller for controlling said regulator.

6. An operation method for controlling discharge pressure of a turbo-compressor using an inlet guide vane and a blow-off valve, comprising:

detecting a value through a temperature detecting means or a pressure detecting means;

obtaining a minimum inlet guide vane angle at that value by referring to data of the minimum inlet guide vane angle, which are memorized in a regulator equipped with said compressor, based upon said value;

driving said inlet guide vane at least at that minimum inlet guide vane angle through a vane driver; and renewing the data of the minimum inlet guide vane angle when surging generates.

7. The operation method as defined by claim 6, wherein said minimum data of the inlet guide vane angle is renewed while opening the inlet guide vane by a predetermined amount when the surging generates within said turbo-compressor.

8. The operation method as defined by claim 6, wherein a characteristic of the discharge pressure of the turbo-compressor to the suction flow rate is memorized into the regulator, and when the inlet guide vane angle which is obtained from said characteristic upon changing of said suction flow rate becomes smaller than the minimum inlet guide vane angle, the inlet guide vane is set at the minimum inlet guide vane angle while opening the blow-off valve.

9. The operation method as defined by claim 6, wherein a deviation of a vane angle is obtained when the discharge pressure is higher than a target discharge pressure, and when the vane angle added with the deviation becomes equal to or less than the minimum inlet guide vane angle, the inlet guide vane is set at the minimum inlet guide vane angle while opening the blow-off valve.

10. The operation method as defined by claim 6, wherein the compressor is shifted into a non-load operation condition by fully opening the blow-off valve and inlet guide vane when the discharge pressure is higher than a target discharge pressure, and wherein when this condition continues for a predetermined time period, then operation of the compressor is stopped.

* * * * *